US005894603A

United States Patent [19]

Capozzi

[11] Patent Number: 5,894,603

[45] Date of Patent: Apr. 20, 1999

[54] HAT OF PLUSH MATERIAL HAVING AN ADJUSTABLE HEADBAND

[75] Inventor: Lee Capozzi, Ridgefield, N.J.

[73] Assignee: Dan Dee International, Jersey City, N.J.

[21] Appl. No.: 08/990,882

[22] Filed: Dec. 16, 1997

[51] Int. Cl.[6] ..... A42B 1/22

[52] U.S. Cl. ..... 2/171.02; 2/183

[58] Field of Search ..... 2/171.02, 171.03, 2/183, 195.2, 195.7

[56] References Cited

U.S. PATENT DOCUMENTS

| | | | |
|---|---|---|---|
| 5,119,514 | 6/1992 | Woehl | 2/195.2 |
| 5,428,843 | 7/1995 | Clowers et al. | 2/183 |
| 5,600,854 | 2/1997 | Henrekin | 2/183 |
| 5,652,959 | 8/1997 | Proctor | 2/183 |

*Primary Examiner*—Diana L. Biefeld
*Attorney, Agent, or Firm*—Amster, Rothstein & Ebenstein

[57] ABSTRACT

A hat of plush material configured and arranged in the form of a Santa Clause cap having a crown and an adjustable headband attached to the crown to enable the hat to be placed around the head of the wearer and maintained in a secure position, the adjustable headband in one embodiment including a first strap and second strap of semi-rigid material respectively attached to the crown to enable the crown to be tightened around the head of the wearer, each of the first and second straps including provisions for fastening the first and second straps to each other at a plurality of locations to provide for tightening the crown around the head of the wearer; wherein, in a preferred embodiment, the crown defines a pair of opposed sides to define a cutout therein proximal to the first and second straps to enable the wearer to manipulate the first and second straps to adjustably tighten the crown around the head of the wearer; and wherein the crown is comprised of a main body section of a primarily conical shape formed of a first plush material and extending from a lower open end to an apex, and a lower band of a second plush material attached to the main body section proximal to the lower end thereof, the lower band of second plush material having fibers of longer length than the first plush material to define a brim of the hat, the crown having a pom-pom disposed at the apex thereof.

8 Claims, 3 Drawing Sheets

FIG. 2
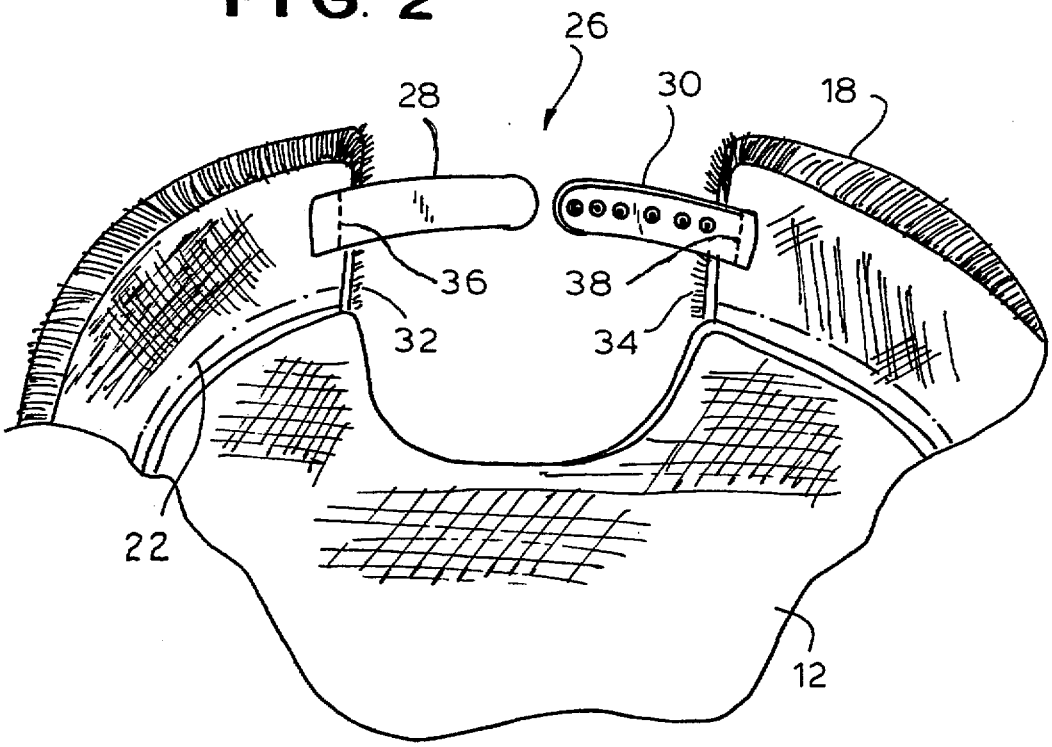
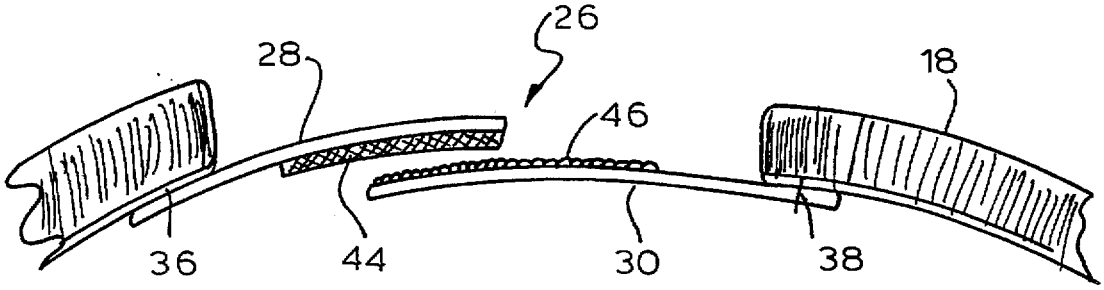
FIG. 3

HAT OF PLUSH MATERIAL HAVING AN ADJUSTABLE HEADBAND

BACKGROUND

The present invention relates generally to hats, and more particularly, to a hat of plush material having an adjustable headband attached to the crown to enable the hat to be placed around the head of the wearer and maintained in a secure position.

The prior art is replete with hats of many shapes and sizes. It is well known to utilize adjustable headbands to provide for the proper fitting of the hat on the head of the wearer. Such arrangements are typically utilized in baseball caps, in which a pair of opposing extensions of semi-rigid material are adapted to engage each other in an overlapping relationship to tension the crown of the hat to fit the wearer. These implementations, however, use hat materials that are relatively non-compliant. None have heretofore employed such an adjustable headband arrangement with a hat fabricated primarily of plush materials. Proper fit of soft hats is usually facilitated by the use of elastic material in the crown area, where the hat is configured with an undersized profile that expands to fit the user's head when worn. This arrangement has a disadvantage in that it can become uncomfortable to wear as a result of the constant non-adjustable tension exerted on the head. Accordingly, it is desirable to provide a hat of a plush material with an adjustable headband to facilitate the desired amount of tension around the head to provide more comfort and a superior fit.

SUMMARY OF THE INVENTION

It is a primary object of the present invention to provide a hat of plush material having an adjustable headband attached to the crown of the hat for tightening the hat around the head of the wearer.

It is another object of the present invention to provide a hat of plush material configured and arranged in the form of a Santa Clause cap, having an adjustable headband feature.

In accordance with these objects and additional objects that will become apparent hereinafter, the present invention provides a hat of plush material having a crown, and an adjustable headband attached to the crown to enable the hat to be placed around the head of the wearer and maintained in a secure position. The adjustable headband including a strap of material extending freely from the crown at a first location on crown, and provisions for fastening the strap at a plurality of locations along the strap to a portion of the crown at a second location on the crown to enable the crown to be tightened around the head of the wearer.

In accordance with another embodiment, the present invention provides a hat of plush material having a crown, and an adjustable headband attached to the crown to enable the hat to be placed around the head of the wearer and maintained in a secure position, the adjustable headband including a first strap and second strap of semi-rigid material respectively attached to the crown to enable the crown to be tightened around the head of the wearer, each of the first and second straps including provisions for fastening the first and second straps to each other at a plurality of locations to provide for tightening the crown around the head of the wearer.

In one embodiment, the provisions for fastening the first and second extensions to each other comprises a plurality of projections on the first strap that are engagable with a plurality of apertures defined in the second strap.

In another embodiment, the provisions for fastening the first and second straps to each other comprises hook and loop material respectively disposed on the first and second straps.

In another embodiment, the provisions for fastening the first and second straps to each other includes a buckle arrangement.

In a preferred embodiment, the crown defines a pair of opposed sides to define a cutout therein proximal to the first and second extensions to enable the wearer to manipulate the first and second extensions to adjustably tighten the crown around the head of the wearer. The crown is comprised of a main body section of a primarily conical shape formed of a first plush material and extending from a lower open end to an apex, and a lower band of a second plush material attached to the main body section proximal to the lower end thereof, the second plush material having fibers of longer length than the first plush material to define a brim of the hat. A pom-pom of plush material is disposed at the apex of the crown to provide a Santa Clause arrangement.

BRIEF DESCRIPTION OF THE DRAWINGS

FIG. 2 is an enlarged detail view of the adjustable headband assembly;

FIG. 3 is a detail view of an alternative fastener construction for the headband straps;

DETAILED DESCRIPTION OF THE PREFERRED EMBODIMENT

Figure 1:
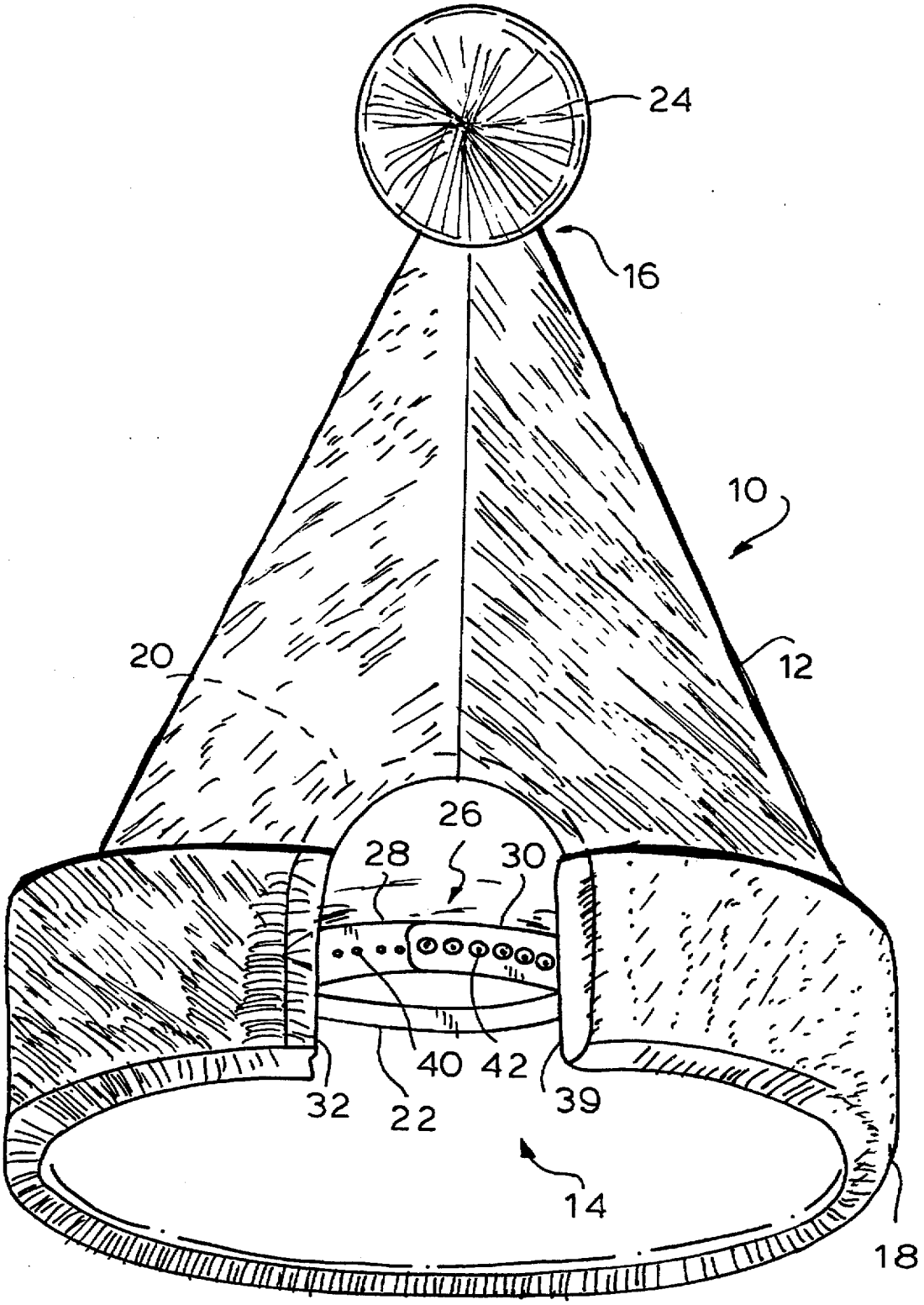
FIG. 1 is an isometric view of a hat in accordance with the present invention.

With reference to the several views of the drawings, there is provided a hat of plush material generally configured in the shape of a Santa Clause cap and characterized by the reference numeral 10. The hat 10 includes a crown having a main body section 12 of a primarily conical shape extending from a lower end 14 to an apex 16. In the illustrative embodiment, the main body section 12 of the crown is fabricated from a first type of plush material having relatively short fibers. The crown further includes a lower band 18 comprised of a plush material having relatively longer fibers is attached to the main body section 12 along a stitch line 22 proximal to lower end 14. The longer fibers of the lower band 18 define a brim of the hat 10. The primarily conical main body section 12 of the crown is fabricated in a conventional manner and stitched together along a plurality of stitch lines 20. A pom-pom 24 is attached at the apex 16 of the main body section 12 of the crown in a conventional manner.

Figure 4:
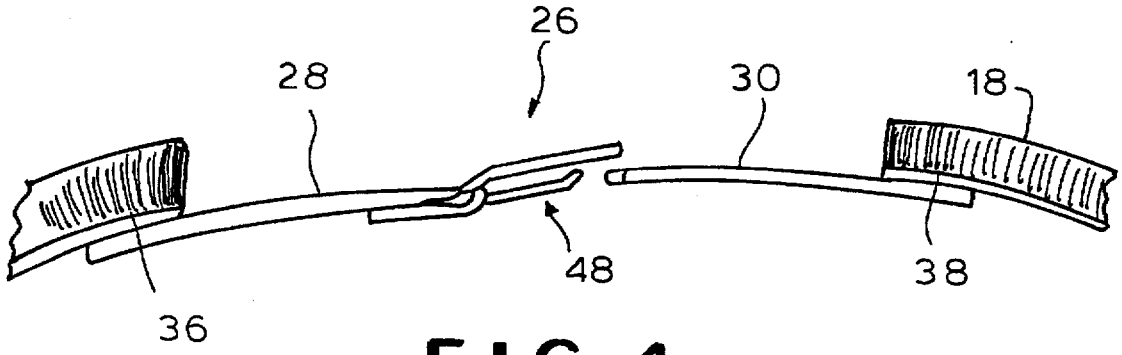
FIG. 4 is a detail view of a buckle arrangement for the headband straps.

The lower band 18 is generally non-elastic and accordingly does not clamp around the head of the wearer. In this regard, tensioning of the lower band 18 is provided by an adjustable headband assembly 26 comprised of first strap 28 and second strap 30, preferably of semi-rigid material. The first and second straps 28, 30 are respectively attached to the lower band 18 proximal to the respective first and second sides 32, 34 thereof. The first and second straps 28, 30 may be attached to the lower band 18 by stitching along stitch lines 36, 38, respectively, or by alternative means such as mechanical fasteners, bonding or the like. Alternatively, the first and second straps 28, 30 may be encapsulated within confronting layers of material (not shown). The first and second straps 28, 30 include cooperating provisions for adjustably fastening the straps 28, 30 to each other at a plurality of locations to enable tightening of the lower band 18 around the wearer's head. In this connection, the first strap 28 includes a plurality of linearly aligned projections 40 that engage corresponding receptacles 42 defined in the second extension 30 in a snap-fit arrangement as is well known in the art. This enables the lower band 18 to be progressively tightened or loosened by simply snapping the projections 40 into the appropriate receptacles 42 through overlapping engagement of the first extension 28 and second extension 30. Alternatively, as shown in FIG. 3, the first and second extensions 28, 30 include respectively disposed patches of hook and loop material 44, 46 such as VELCRO as is well known in the art. In yet another embodiment shown in FIG. 4, a buckle 48 if provided to join straps 28, 30 in a conventional manner.

Figure 5:
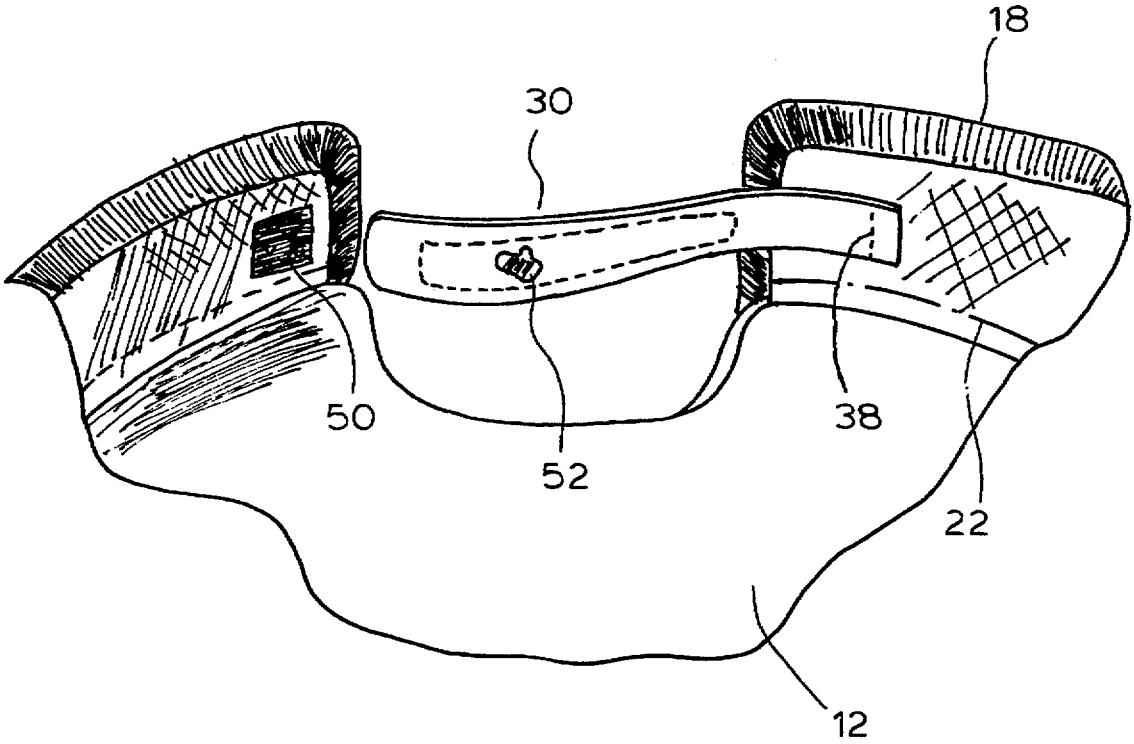
FIG. 5 is an enlarged detail view of a single strap adjustable headband assembly.

Referring now to FIG. 5, there is shown a single strap embodiment, including an elongated strap 30 attached to body section 12 at a first location thereon. A patch of hook/loop material 50 is disposed at a second location on body section 12, and cooperates with hook/loop material 52 associated with strap 30 to adjust the tension of lower band 18 in a manner similar to that described above. Alternatively, the hook/loop material shown may be replaced by a mechanical fastener construction as implemented in the dual strap embodiment illustrated in FIGS. 1 and 2, or other snap-like arrangement.

In either implementation, the headband 26 enables manual tensioning adjustment to be made around the head of the wearer with a minimum of effort and eliminates the prior art practice of an elastic band of material that exerts a constant tension on the head.

The present invention has been shown and described in what are considered to be the most practical and preferred embodiments. It is anticipated, however, that departures made be made therefrom and that obvious modifications will be implemented by persons skilled in the art.

I claim:

1. In a hat of plush material having a crown, an adjustable headband attached to the crown to enable said hat to be placed around the head of a wearer and maintained in a secure position, said adjustable headband including a strap of material extending freely from said crown at a first location on said crown, and means for fastening said strap at a plurality of locations along said strap to a portion of said crown at a second location on said crown to enable said crown to be tightened around the head of a wearer;

wherein said crown is comprised of a main body section of a primarily conical shape formed of a first plush material and extending from a lower open end to an apex, and a lower band of a second plush material attached to said main body section proximal to said lower end thereof, said lower band of second plush material having fibers of longer length than said first plush material to define a brim of said hat, said crown having a pom-pom disposed at said apex thereof.

2. The hat of plush material recited in claim 1, wherein said means for fastening said strap to said portion of said crown at said second location on said crown comprises hook and loop material respectively disposed on said strap and said crown at said second location on said crown.

3. The hat of plush material recited in claim 1, wherein said means for fastening said strap to said portion of said crown at said second location on said crown comprises a plurality of projections on said strap that are engagable with at least one aperture defined in a snap receptacle disposed on said crown at said second location on said crown.

4. In a hat of plush material having a crown, an adjustable headband attached to the crown to enable said hat to be placed around the head of a wearer and maintained in a secure position, said adjustable headband including a first strap and second strap of material respectively attached to said crown, each of said first and second straps including means for fastening said first and second straps to each other at a plurality of locations to provide for tightening said crown around the head of a wearer;

wherein said crown is comprised of a main body section of a primarily conical shape formed of a first plush material and extending from a lower open end to an apex, and a lower band of a second plush material attached to said main body section proximal to said lower end thereof, said lower band of second plush material having fibers of longer length than said first plush material to define a brim of said hat, said crown having a pom-pom disposed at said apex thereof.

5. The hat of plush material recited in claim 4, wherein said means for fastening said first and second straps to each other comprises a plurality of projections on said first strap that are engagable with a plurality of apertures defined in said second strap.

6. The hat of plush material recited in claim 4, wherein said means for fastening said first and second straps to each other comprises hook and loop material respectively disposed on said first and second straps.

7. The hat of plush material recited in claim 4, wherein said means for fastening said first and second straps to each other comprises a buckle associated with said first and second straps.

8. The hat of plush material recited in claim 4, wherein said crown defines a pair of opposed sides to define a cutout therein proximal to said first and second straps to enable the wearer to manipulate said first and second straps to adjustably tighten said crown around the head of a wearer.

* * * * *